US006845334B2

(12) United States Patent
Colburn

(10) Patent No.: US 6,845,334 B2
(45) Date of Patent: Jan. 18, 2005

(54) SYSTEM FOR DETERMINING A LINKAGE POSITION

(75) Inventor: Stephen Colburn, Eureka, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/310,993

(22) Filed: Dec. 6, 2002

(65) Prior Publication Data

US 2004/0111229 A1 Jun. 10, 2004

(51) Int. Cl.[7] ..... G06F 19/00
(52) U.S. Cl. ..... 702/94
(58) Field of Search ..... 702/1, 50–153; 701/50; 414/680, 691, 707, 710, 712

(56) References Cited

U.S. PATENT DOCUMENTS 4,318,663 A * 3/1982 Waite ..... 414/707
4,606,696 A * 8/1986 Slocum ..... 414/744.2
6,185,493 B1 2/2001 Skinner et al. ..... 701/50
6,234,254 B1 * 5/2001 Dietz et al. ..... 172/3
6,246,939 B1 6/2001 Nozawa ..... 701/50
6,374,147 B1 4/2002 Rockwood ..... 700/69

OTHER PUBLICATIONS

Luengo, O., et al., "Modeling and Identification of Soil–tool Interaction in Automated Excavation", *In Proceedings, IEEE/RSJ International Conference on Intelligent Robotic Systems*, Oct. 13–17, 1998.

* cited by examiner

*Primary Examiner*—Michael Nghiem
(74) *Attorney, Agent, or Firm*—Finnegan, Henderson, Farabow, Garrett & Dunner, L.L.P.

(57) ABSTRACT

A method for determining a compensated first position of a linkage of a machine is disclosed. The method includes sensing a first position of the linkage, determining a first deflection value based on the sensed first position, and utilizing the sensed first position and the determined deflection value to calculate a compensated first position of the linkage. The method may be used for determining a compensated offset distance between a first and a second position of a linkage of a machine.

26 Claims, 4 Drawing Sheets

SYSTEM FOR DETERMINING A LINKAGE POSITION

TECHNICAL FIELD

This disclosure relates to a system and method for determining the position of a linkage of a machine. More specifically, this disclosure relates to a method and system for including a deflection value in determining the linkage position.

BACKGROUND

Work machines, such as excavators, backhoes, and other digging machines, are used to excavate or dig holes, ditches, and the like. In some applications, these excavations are required to have a specific depth or be a specific distance away from a given point, such as a wall. In one example, the excavation is for a pipe whose contents must run downhill. The required depth of the excavation could be set forth on a blueprint. In order to determine the depth at which an operator is digging, it is necessary to measure the depth from a known point to the bottom of the excavation. To perform such a measurement, the operator typically touches a bucket tip of the work machine at a first reference point, such as the top of a surveyor's stake, and then moves the bucket tip to a second reference point, which could be located within the excavation. The distance between the first and the second reference points is the offset distance.

In another example, the excavation must be a specific horizontal distance away from a given point, such as an existing structure or a property boundary. In order to determine the horizontal offset distance, and thereby determine where to dig, the operator may touch the bucket tip of the work machine at a first reference point, such as the structure or the boundary line, and then move the bucket tip to a second reference point, where the digging is to occur. Again, the distance between the first and the second reference points is the offset distance.

Some work machines are equipped with a computer system, including software, that is capable of computing the position of the bucket tip. The computer system typically inputs values received from sensors into a kinematics model of the digging linkage to determine its position. For example, U.S. Pat. No. 6,185,493 to Skinner et al. discloses a system for controlling the bucket position of a loader. The system includes position sensors that determine the elevational position of the boom and the pivotal position of the bucket to produce bucket position signals. The system determines the instantaneous position of the bucket.

However, several sources of error may affect the accuracy of the position determined with existing computer systems. For example, if any part of the linkage deviates from the kinematics model dimensions, there will be a discrepancy between the actual position and the measured position of the linkage. One such source of potential error is the flexibility of the linkage components. Gravitational forces or other external forces can cause the digging linkage to deflect from the nominal shape of the kinematics model. Because of the shape of the digging linkage, this deflection may occur in both the horizontal and vertical directions when measured at a bucket tip. Because of the error, the actual linkage position differs from the determined linkage position, in both the horizontal and vertical directions by a deflection value. Because the determined positions are not accurate, a calculated offset distance between the first and the second positions is also not accurate.

This disclosure is directed toward overcoming one or more of the problems or disadvantages associated with the prior art.

SUMMARY OF THE INVENTION

In one aspect of the system, a method for determining a compensated first position of a linkage of a machine is disclosed. The method includes sensing a first position of the linkage, determining a first deflection value based on the sensed first position, and utilizing the sensed first position and the determined deflection value to calculate a compensated first position of the linkage.

In another aspect, a method for determining a compensated offset distance between a first and a second position of a linkage of a machine is disclosed. The method includes the steps of sensing a first position and a second position of the linkage and determining a deflection value based upon the sensed first and second position. A compensated offset distance of the linkage is determined based on the sensed first and second positions and the deflection value.

In another aspect, a system for determining a compensated first position of a linkage of a machine is disclosed. The system includes at least one sensor operably associated with the machine. The sensor is configured to sense a first position of the linkage. The system also includes a memory component including a data structure for determining the compensated first position of the linkage based on the sensed first position and a first deflection value. The first deflection value is based upon the sensed first position. The system also includes a processor for executing the data structure to determine the compensated first position of the linkage.

In another aspect, a system for determining a compensated offset distance between a first and a second position of a linkage of a machine is disclosed. The system includes at least one sensor operably associated with the machine and configured to sense a first position and a second position of the linkage. The system also includes a memory component including a data structure for determining the compensated offset distance of the linkage based on the sensed first and second positions and a deflection value, the deflection value being based upon the sensed first and second positions. Finally, the system includes a processor for executing the data structure to determine the compensated offset distance of the linkage.

BRIEF DESCRIPTION OF THE DRAWINGS

The foregoing and other features and advantages of the system and method will be apparent from the following more particular description, as illustrated in the accompanying drawings.

DETAILED DESCRIPTION

Figure 1A:
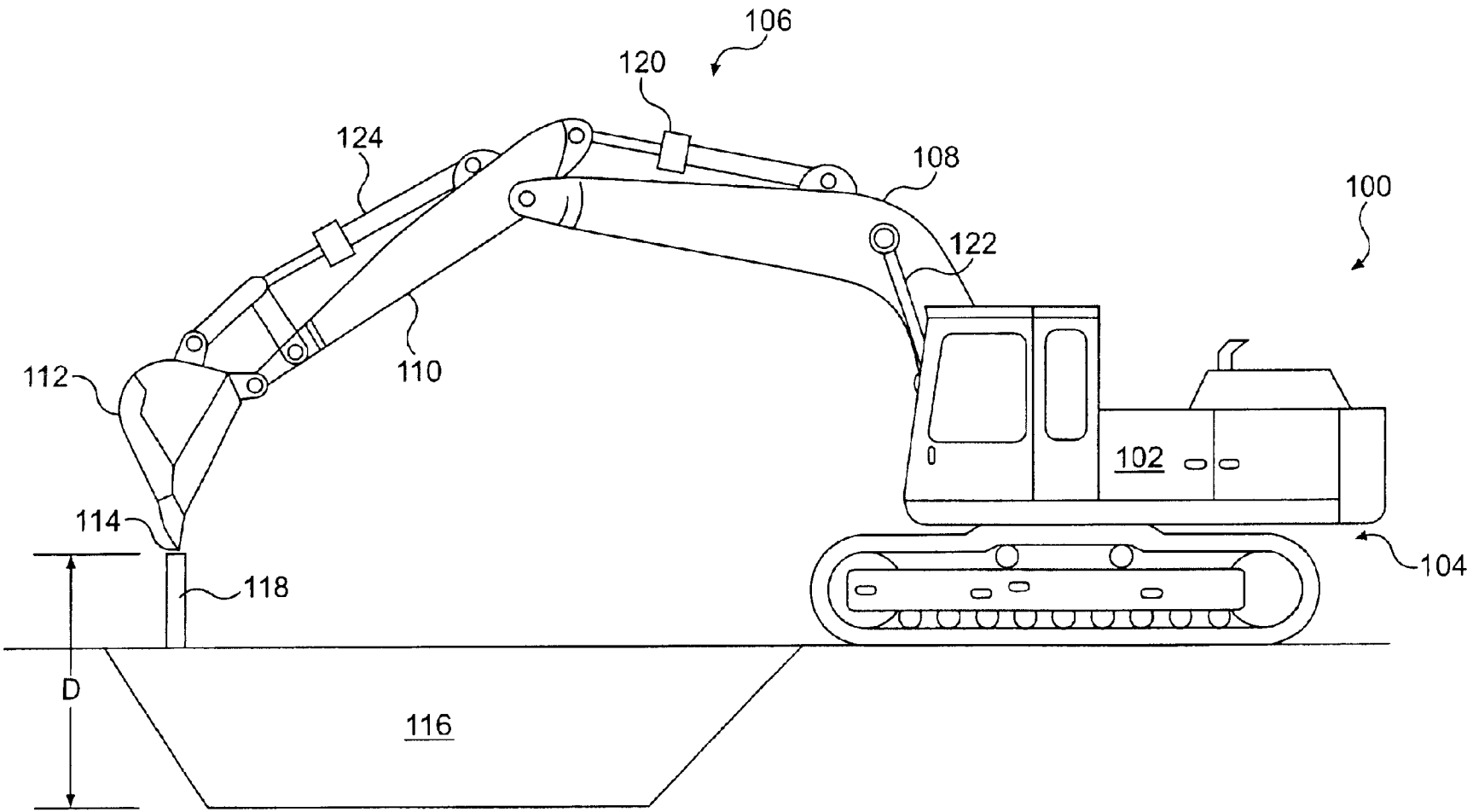
FIG. 1A is a diagrammatic side view of an excavator with a digging linkage at a first position.

FIG. 1A shows a work machine 100 having a housing 102 mounted upon an undercarriage 104. Although in this exemplary embodiment the work machine 100 is shown as an excavator, the work machine 100 could be a backhoe or any other machine that may require measuring the distance between a first position and a second position. The work machine 100 includes a digging linkage 106. The digging linkage 106 includes a boom 108, a stick 110, and a work implement 112. The work implement 112 includes a work implement tip 114. A hole or excavation 116 is shown below the digging linkage 106. A surveyor's stake 118 may be driven into the ground adjacent to the excavation 116.

Movement of the digging linkage 106 may be accomplished by a stick cylinder actuator 120, a boom cylinder actuator 122, and a work implement cylinder actuator 124. These actuators are configured to provide movement to the digging linkage 106 as is known in the art.

FIG. 1A shows the digging linkage 106 at a first position. In this first position, the work implement tip 114 is situated at the top of the surveyor's stake 118. The top of the surveyor's stake 118 is used as a first reference point. The height of the surveyor's stake 118 may be a known height and can be determined using methods known in the art.

Figure 1B:
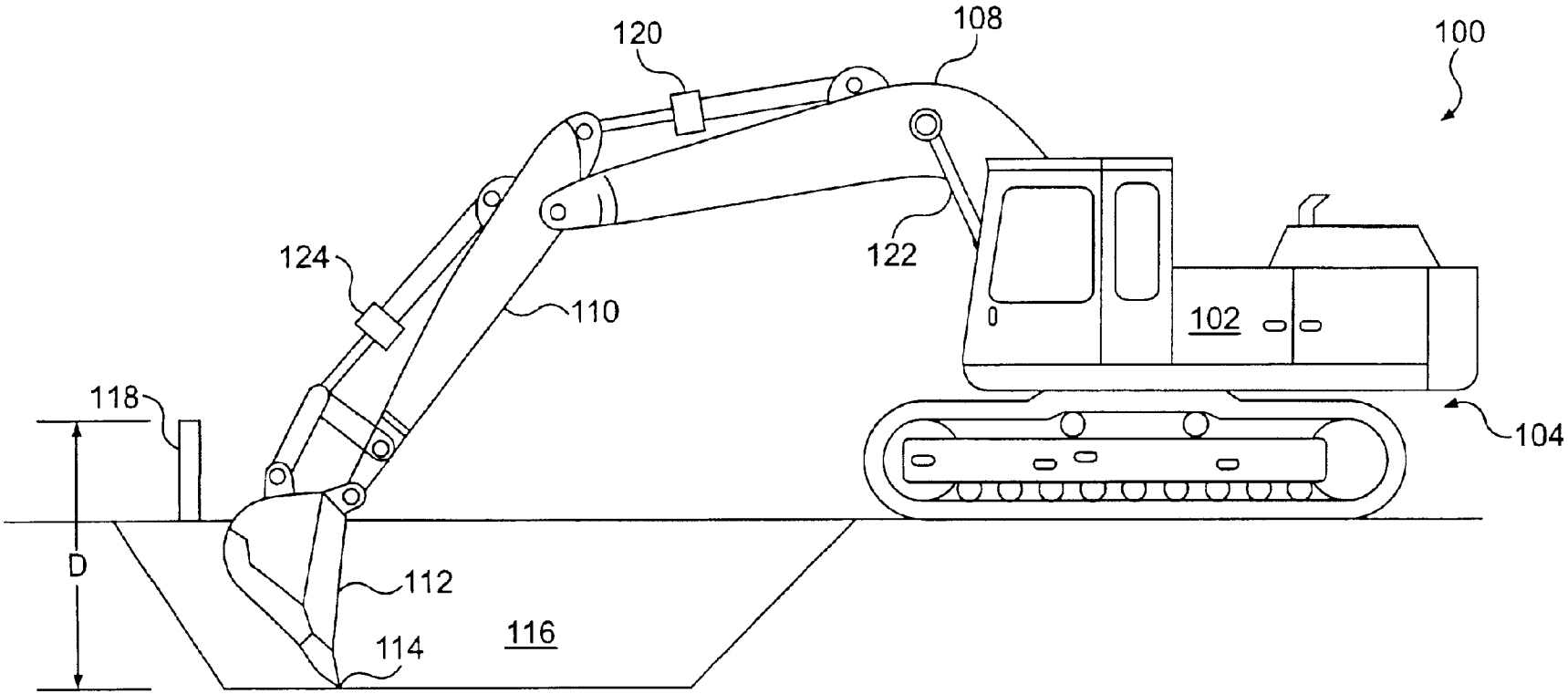
FIG. 1B is a diagrammatic side view of the excavator of FIG. 1A with the digging linkage at a second position.

FIG. 1B shows the work machine 100 with the digging linkage 106 at a second position. The work implement tip 114 may be touching the bottom of excavation 116. For an operator to dig the excavation at a specified depth, it is important that the operator know the distance between a known first position and the bottom of the excavation. The vertical offset distance D between the first and second positions is the distance between the top of the surveyor's stake 118 and the bottom of the excavation 116. Although in this exemplary embodiment the surveyor's stake 118 is used as the reference point for the first position, any reference point could be used, as would be apparent to one skilled in the art.

A horizontal offset distance (not labeled in FIG. 1) is the horizontal distance between the first and second positions. This horizontal offset distance may be important in situations where, for example, the operator is instructed to dig a given distance away from an existing structure or a property boundary.

It should be noted that in FIGS. 1A and 1B, the offset distance D is the distance between the work implement tip 114 in FIG. 1A and the work implement tip 114 in FIG. 1B. However, as would be apparent to one skilled in the art, the offset distance may be measured from any point on the digging linkage 106 of the work machine 100. For example, the offset distance could be the distance between the end of the stick 110 in FIG. 1A and the end of the stick 110 in FIG. 1B.

In the first and second positions, the digging linkage 106 may be deflected slightly due to the gravity. Depending on the position of the digging linkage, the work implement tip 114 of the digging linkage 106 may be displaced, due to the deflection, in both the horizontal and vertical directions. An exemplary electronic system 200, described below, can determine the position of the digging assembly and the amount of deflection. The electronic system 200 may also be used to compensate the offset distances by the deflection amounts.

Figure 2:
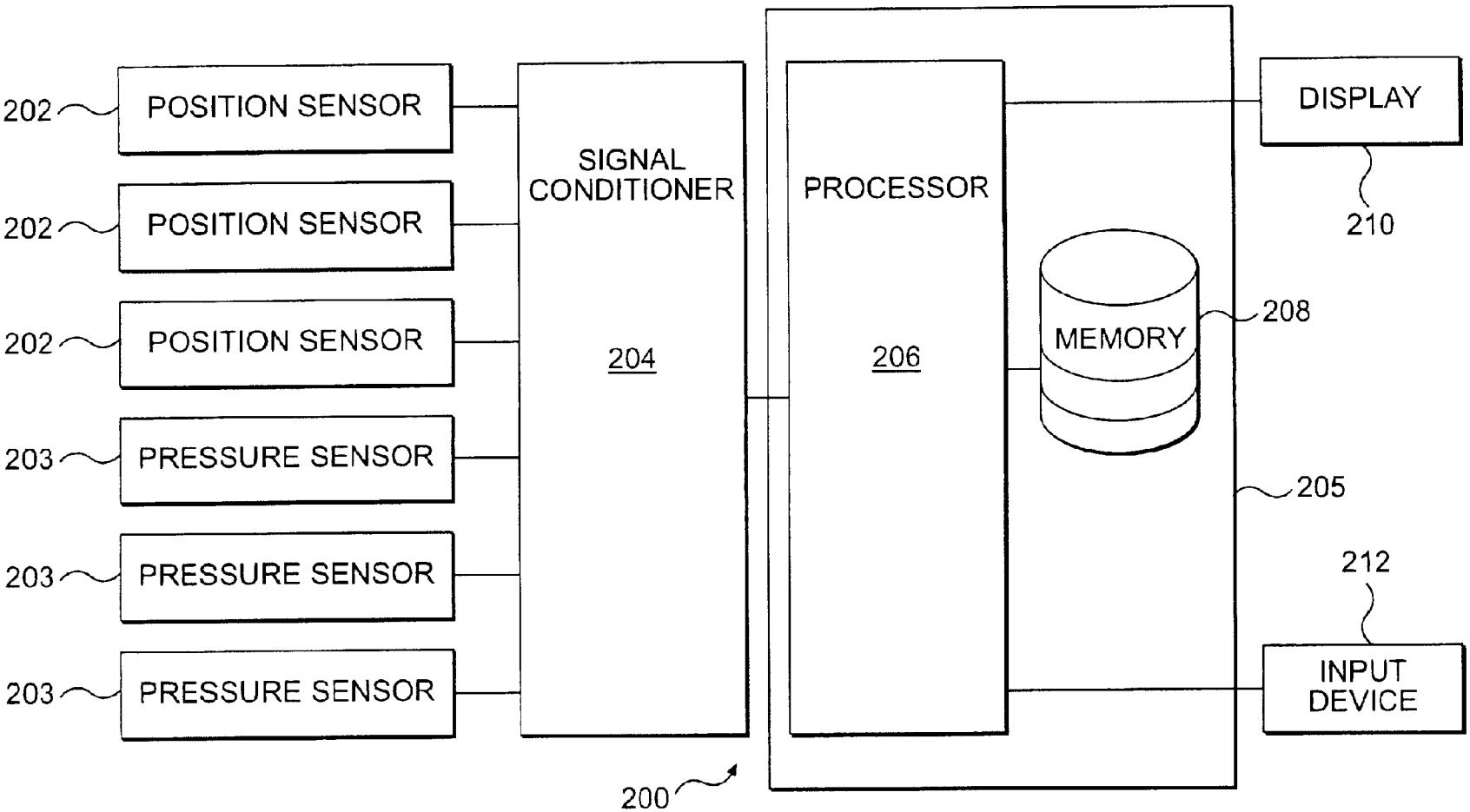
FIG. 2 is a block diagram of an exemplary electronic system.

FIG. 2 is a block diagram of the exemplary electronic system 200 for use on the work machine 100 of FIG. 1. The electronic system 200 may include one or more position sensors 202 for determining the position of the digging linkage 106. For example, a position sensor may be operably associated with the stick cylinder actuator 120, the boom cylinder actuator 122, and the work implement cylinder actuator 124. The sensors could be, for example, length potentiometers, radio frequency resonance sensors, rotary potentiometers, yo-yos, or the like.

The electronic system 200 may also include one or more pressure sensors 203 for measuring the pressure in the stick cylinder actuator 120, the boom cylinder actuator 122, and the work implement cylinder actuator 124. When the cylinder actuators are hydraulic actuators, the pressure sensors 203 may be fluid pressure sensors. The pressure sensors 203 may be located within the heads of the cylinder actuators. In one exemplary embodiment, two pressure sensors 203 are associated with each hydraulic actuator, with one pressure sensor at each end. The pressure sensors 203 and the position sensors 202 enable the electronic system 200 to determine the magnitude and direction of loads applied to the digging linkage 106.

In another exemplary embodiment, strain gauge sensors are used at the joints of the digging linkage 106 to measure the forces operating at the joints. The strain gauges may be placed on pins at the joints, and may measure the forces applied to the pins. The electronic system 200 may determine the magnitude and direction of loads applied to the digging linkage 106 based on signals from the strain gauges and the position sensors 202 on the digging linkage 106. It should be understood that the strain gauges could be used in place of the pressure sensors 203 as described herein.

The position sensors 202 and the pressure sensors 203 may communicate with a signal conditioner 204 for conventional signal excitation, scaling, and filtering. In one exemplary embodiment, the signal conditioner 204 is located remote from position and pressure sensors 202, 203. In another exemplary embodiment, each individual position and pressure sensor 202, 203 contains a signal conditioner 204 within its sensor housing.

The signal conditioner 204 is in electronic communication with a computer system 205. In one exemplary embodiment, the signal conditioner 204 is part of the computer system 205. The computer system 205 may be disposed on-board the work machine 100 or, alternatively, may be remote from the work machine 100, and may be in communication with the work machine through a remote link.

The computer system 205 may contain a processor 206 and a memory component 208. The processor 206 could be a microprocessor or other processor as is known in the art. The memory component 208 is in communication with the processor 206. The memory component 208 provides storage of data structures, information, and algorithms, such as a kinematics model of the digging linkage, which are capable of determining the position of the digging linkage 106.

The memory component 208 may include a data structure for determining a "measured offset distance," which is the distance between the sensed first and second positions, as determined by the kinematics model based on the sensor signals. For purposes of clarity, the position of the digging linkage based on the sensor outputs is referred to as the sensed position.

The memory component 208 may include an additional data structure for determining the deflection value of the digging linkage based on the sensed position of the digging linkage. The deflection value may be combined with the sensed position to determine a compensated position. The data structure may also calculate a "compensated offset distance," which is the compensated, or actual, distance between the compensated first and second positions, or, in other words, the measured offset distance including the deflection values at the two positions.

A display 210 may be operably associated with the processor 206. The display 210 may be disposed within the housing 102 of work machine 100, and may be referenced by the work machine operator. Alternatively, the display 210 may be disposed outside the housing 102 of the work machine 100 for reference by workers in other locations. The display 210 is configured to display the compensated offset distance between the first position and the second position of the digging linkage 106.

An input device 212 may be associated with the computer processor 204 for inputting information or operator instruction. The input device 212 could be any standard input device known in the art.

One exemplary method of developing the data structures for calculating the deflection of the digging linkage 106 at various positions includes using a computer-aided design system, such as, for example, Pro/Engineer, to conduct finite element analysis. The digging linkage is modeled within the system, and the known forces are entered into the system as force loads on the model. At a minimum, the force loads are the gravitational loads due to the mass of the boom 108, the stick 110, and the work implement 112. Other loads may include, for example, loads applied against the work implement by the ground during digging and the weight of material held by work implement 112. The deflection at the work implement tip 114 may be calculated and recorded by the computer-aided design system for the given position of the digging assembly model.

The design system then calculates the deflection at other potential positions of the digging linkage model. When the deflection at a sufficient number of positions has been determined, a curve may be fitted to the deflection using methods known in the art. An algorithm that follows the curve may be determined using known methods. Using the algorithm, the deflection of the digging linkage 106 may be determined at any position. The algorithm may be incorporated into a data structure and stored in the memory component 208. The effect of externally applied loads on the actuator pressures at various positions may also be mapped during the finite element analysis and saved in the memory component 208 as algorithms or data tables. This information may be used for determining applied loads based on the sensed position of the digging linkage and the actuator pressures.

In one exemplary embodiment, the algorithm for determining the deflection of the digging linkage at a given position is based upon the sensed position of the digging assembly and the sensed pressure within the cylinder actuators. The position of the digging linkage may be determined from the positions sensors, while the pressure within the cylinder actuators indicates whether the digging linkage 106 is being supported as a cantilever extending from the body of the work machine 100, or whether the digging linkage 106 is being supported at each end, such as, for example, by the body of the work machine 100 and the surveyor's stake 118. As such, the pressure sensors 203, along with the position sensors 202, may determine whether the digging linkage is under any load other than the gravitational load of the assembly itself. For example, if the work implement 112 is being pushed downward against the surveyor's stake by the actuators of the digging linkage 106, the pressures in the actuators will indicate that loads are being applied against the work implement, and that deflection of the digging linkage may be away from the ground instead of toward the ground.

Likewise, the data structure may determine the deflection of the digging linkage at a given position during the digging process. The algorithm may compute and consider the forces applied against the work implement by the soil while digging. In one exemplary embodiment, after an operator has dug a trench to near the desired depth, the operator may finish the excavation by moving the bucket horizontally, removing thin layers of soil until a desired depth is reached. Here, the applied load may be a digging force on the bucket tip. Under these controlled conditions, the load will be fairly constant, and may be estimated from known methods, such as, for example, Reece's equation. The algorithm may then be used to determine the deflection value of the digging linkage based on the applied loads and the data structure. By monitoring the position and pressure sensors 202, 203, other applied loads may be determined based on algorithms determined using finite element analysis and/or other known equations as described above.

It should be noted that the data structure for determining the deflection of the digging linkage 106 at either the first or second positions could contain an algorithm based solely on a cantilever model. In such an exemplary embodiment, the operator should carefully place the digging linkage 106 at the first and second reference points such that the work implement tip 114 only lightly contacts the top of the reference points, such as the surveyor's stake 118 and the bottom of the excavation 116, thereby ensuring that no appreciable amount of weight is supported at the reference points. Thus, the digging linkage 106 is primarily supported as a cantilever at the first and the second positions extending from the body of the work machine 100. In such a cantilever model, the only loads applied to the digging linkage 106 are the known actual weights of the components. The algorithm may then be used to determine the deflection value of the digging linkage based on the data structure without considering the effects of other applied loads.

In yet another exemplary embodiment, the data structure contains an algorithm for determining the deflection of the digging linkage 106 at a given position while digging using a dynamic load analysis. The data structure considers the acceleration, velocity, and inertia of the digging linkage during the digging process. In this exemplary embodiment, the applied loads may be from the ground against the work implement, or from the movement and rotation of the work implement when loaded or unloaded. The change in position and load may be monitored by the position and pressure sensors 202, 203 and used to determine the amount and direction of deflection of the digging linkage throughout a digging cycle.

The deflection values at the first and second positions are combined with the sensed first and second positions to determine a compensated position and/or a compensated offset distance. As described above, the compensated position is the sensed position that is compensated for the deflection. The compensated offset distance is the actual distance between the compensated first and second positions.

In the exemplary embodiments described above, the second position of the digging linkage may be a moving or dynamic position. In one exemplary embodiment, the compensated offset distance may be continuously calculated and displayed during operation. In other words, the second position may be in a continuous state of motion. Accordingly, the operator may monitor the depth of the excavation from the first position or reference point without stopping the digging process. In another exemplary embodiment, the compensated offset distance is determined as a snapshot of the digging linkage at a point in time. The sensed parameters at the point in time may be used to determine the deflection of the digging linkage. It should be noted that although the above embodiments are described as having different data structures configured to determine the deflection under separate loading scenarios, a single data structure may be used to determine the deflection under more than one of the scenarios described above.

In one exemplary embodiment, the data structures contained in the memory component 208 may include a number of data boxes. The data boxes may be merely sub-routines within the data structures. A first data box of a data structure may be an algorithm for calculating the measured offset distance, based on the kinematics model stored within the memory component 208. The data structure may include a second data box for determining the deflection value at both the first and the second positions. The second data box may also include algorithms for determining the applied forces to the digging linkage. The data structure may include a third data box which combines the measured offset distance with the deflection value to determine the compensated offset distance between the first and second positions. The compensated offset distance may be calculated as a vertical or a horizontal distance between the first and second positions. In one embodiment, the compensated offset distance is calculated as an angled distance between the first and second positions. The angled distance may be based upon the horizontal and vertical compensated offset distances.

Figure 3:
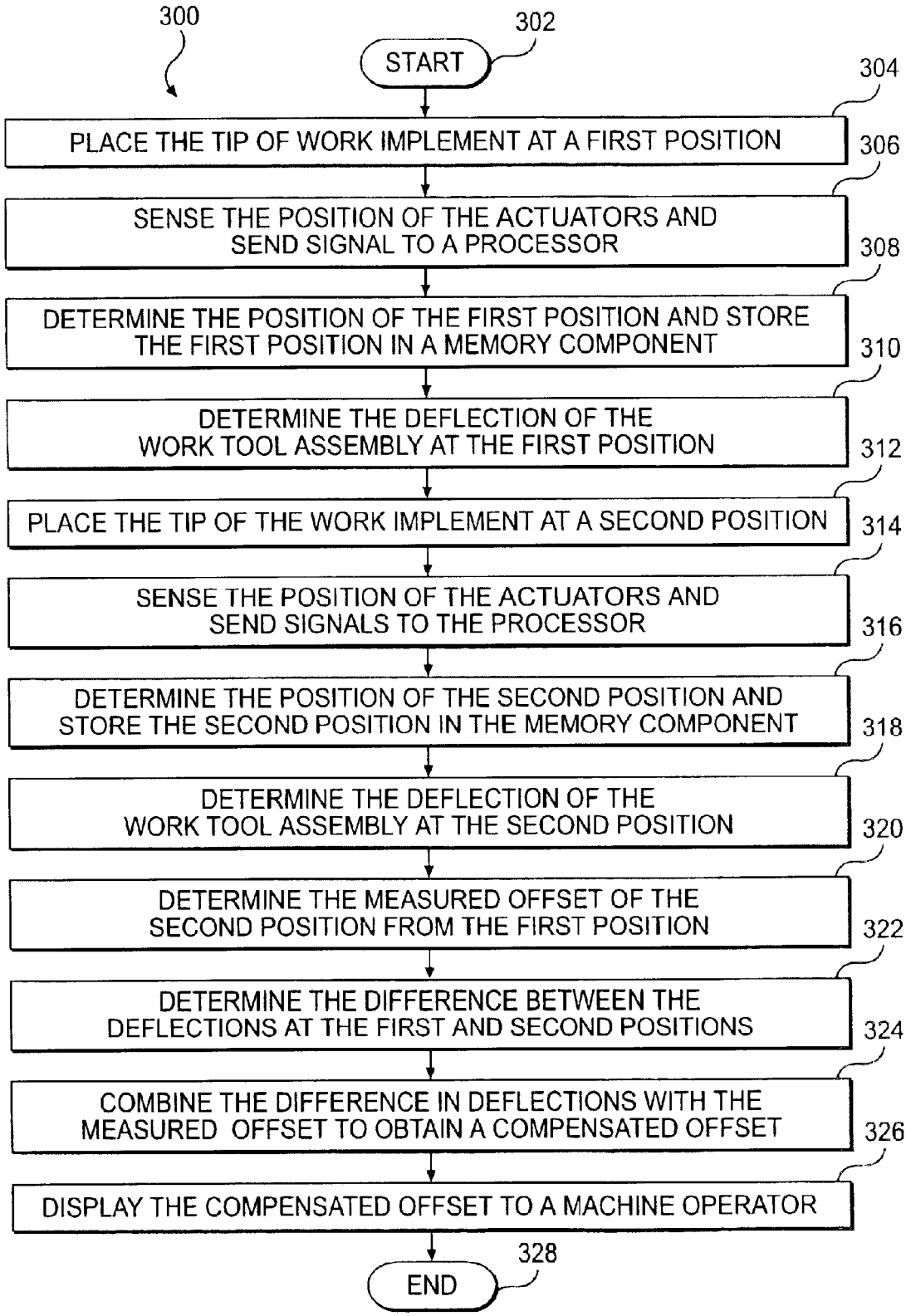
FIG. 3 is a flowchart of an exemplary method for determining a compensated offset distance.

While the described system can be implemented in a number of ways, FIG. 3 is a flow chart of an exemplary method. This exemplary method will be described in the following section.

Industrial Applicability

The flow chart 300 of FIG. 3 shows steps for determining the compensated offset distance between the first and second positions of the digging linkage 106. At a step 302, the flow chart starts with powering the system. Powering the system may be accomplished by turning the system on using a switch or by powering the work machine 100. At a step 304, the operator maneuvers the digging linkage 106 to place the work implement tip 114 at a first position. At a step 306, the position and pressure sensors 202, 203 sense the position of the actuators and/or the fluid pressure within the actuators. The position and/or pressures are sent as position and pressure signals to the processor 206. As explained above with reference to FIG. 2, the signals may be modified by a signal conditioner prior to being received at the processor 206.

In one exemplary embodiment, the operator triggers the sensing of the first position with a triggering switch or signal sent to the processor 206 that indicates that the digging linkage 106 is at the first position and that a measurement should be taken. Accordingly, in this embodiment, when the processor 206 is signaled to indicate that the digging linkage 106 is at the first position, the processor 206 receives the measurements from the sensors 202, 203. This triggering may be accomplished through the input device 212.

At a step 308, the system determines the location of the digging linkage 106 at the first position based on the signals from the position sensors 202. The system may also determine whether any external loads are applied to the digging linkage based on the signals from the pressure sensors 203. The location may be stored as the first position in the memory component 208 of the computer system 205. Any external loads may also be stored within the memory component 208.

At a step 310, the computer system 205 determines the deflection of the digging linkage 106 at the first position. The deflection may be based on data structures, the sensed position, and the sensed fluid pressures. The deflection of the digging linkage 106, like the first position itself, may be stored in the memory component 208 of the computer system 205.

As set forth above with reference to FIG. 2, the step of determining the deflection of the digging linkage 106 may be accomplished by a data structure or a data box within a data structure that is capable of determining the deflection of the digging linkage 106 at a given position. Likewise, determining the position of the digging linkage may be accomplished by separate data boxes within the same or a different data structure.

At a step 312, the operator moves the digging linkage from the first position to a second position. The second position may be a fixed position, or may be a snapshot of an instantaneous position at a moment in time during the actual digging process.

At a step 314, the sensors sense the position of the actuators and/or the pressure within the actuators and send the position and/or pressure to the processor. The position sensors 202 determine the location of the second position. In one exemplary embodiment, the operator indicates to the computer system 205 that the digging linkage is at the second position through the input device 212. In another exemplary embodiment, the system continuously senses the second position of the digging assembly.

At a step 316, the data structure determines the location of the second position. The data structure may also determine whether any external loads are applied at the second position. The second position of the digging linkage and any external loads may be stored in the memory component 208 of the computer 205. At a step 318, the system determines the deflection of the digging linkage at the second position based upon the sensed position and any external loads applied at the second position. The step of determining the deflection may be accomplished using a data structure or data box as described above.

At a step 320, the system determines the measured offset distance of the second position from the first position. The measured offset distance is determined by comparing the location of the sensed first position as was stored in the memory component to the location of the sensed second position of the digging linkage.

At a step 322, the total deflection at the first position and the second position may be determined based upon the difference between the calculated deflections from the first and second positions, including both magnitude and direction. As stated above, step 320 and step 322 may be accomplished through a data structure or a data box within a data structure.

At a step 324, the difference in the deflections may be combined with the measured offset distance to obtain a compensated offset distance. The compensated offset distance includes the measured distance plus the deflection value to determine a more accurate distance between the first position and the second position.

In the exemplary embodiment described, the measured offset distance is first calculated, the deflections are determined, and then the deflections are combined with the measured offset distance to obtain the compensated offset distance. In another exemplary embodiment, the sensed positions are first determined and combined with the respective deflections to provide first and second compensated positions. Then, the compensated positions are used to determine the compensated offset distance.

At a step 326, the compensated offset distance may be displayed to a machine operator through the display 210. At a step 328, the flow chart ends.

In one exemplary embodiment, the system for conducting finite element analysis is operably associated with the work machine 100 and contained on the work machine 100. Accordingly, finite element analysis is conducted at the first position and at the second position to determine the deflection values at those positions.

In another exemplary embodiment, an algorithm obtained through finite element analysis is used to prepare a table for showing the deflection value at various work positions of the digging linkage 106. The table could be stored within the memory component 208, and added to the measured offset distance or, alternatively, the table could be printed for reference by a machine operator. Accordingly, in this exemplary embodiment, the operator could determine the position of the digging linkage and then look at the table to determine the deflection at that position.

It is often necessary to measure an offset distance between two points when using an excavator, backhoe or other work machine. The described system enables an operator to accurately and quickly determine the offset distance. By considering the deflection value of the digging linkage when determining the depth or the horizontal distance of an excavation, a more accurate offset distance may be determined than was previously obtainable. Although the method is described with reference to a work machine, such as an excavator or backhoe, the system could be used on any machine having a linkage or component capable of extending between two positions.

Other embodiments will be apparent to those skilled in the art from consideration of the specification and practice disclosed herein. It is intended that the specification and examples be considered as exemplary only, with a true scope of the disclosure being indicated by the following claims.

What is claimed is:

1. A method for determining a compensated first position of a linkage of a machine, comprising:

sensing a first position of the linkage;

determining a first deflection value based on the sensed first position, the deflection value being a distance between an actual first position of the linkage and the sensed first position as a result of flex of the linkage due to a load on the linkage; and utilizing the sensed first position and the determined first deflection value to calculate a compensated first position of the linkage.

2. The method of claim 1, further including:

sensing a second position of the linkage;

determining a second deflection value based on the sensed second position;

utilizing the sensed second position and the determined second deflection value to calculate a compensated second position of the linkage; and determining a compensated offset distance of the linkage between the compensated first and second positions.

3. A method for determining a compensated offset distance between a first and a second position of a linkage of a machine, comprising:

sensing a first position and a second position of the linkage;

determining a measured offset distance of the linkage between the sensed first and second positions based on the sensed first and second positions;

determining a deflection value based upon the sensed first and second positions; and determining a compensated offset distance of the linkage based on the sensed first and second positions and the deflection value by compensating the measured offset distance with the deflection value based on the sensed first and second positions of the linkage to obtain the compensated offset distance.

4. The method of claim 3, further including:

displaying the compensated offset distance in a cab of the machine.

5. The method of claim 3, wherein determining a deflection value includes obtaining the deflection value from finite element analysis.

6. The method of claim 5, wherein the finite element analysis is performed on-board the machine.

7. The method of claim 3, wherein determining a deflection value includes obtaining the deflection value of the linkage from a table based on the sensed first and second positions.

8. The method of claim 3, further including maintaining a data structure in a memory component that determines the compensated offset distance by combining a measured offset distance and the deflection value based on the sensed first and second positions; and processing the data structure to obtain the compensated offset distance.

9. The method of claim 8, further including:

processing a first data box of the data structure to calculate a measured offset distance based upon the sensed first and second positions;

processing a second data box of the data structure to calculate the deflection value at the first and second sensed positions; and processing a third data box of the data structure to combine the measured offset distance and the deflection value and to determine the compensated offset distance.

10. The method of claim 9, wherein the second data box includes an algorithm based on a curve developed by conducting finite element analysis on the linkage.

11. The method of claim 3, including determining the effects of external loads applied to the linkage, the deflection value being further based upon the external loads.

12. The method of claim 3, further including:

continuously updating the second position;

continuously calculating the compensated offset distance during a digging process; and displaying the continuously calculated compensated offset distance.

13. A system for determining a compensated first position of a linkage of a machine, comprising:

at least one sensor operably associated with the machine and configured to sense a first position of the linkage;

a memory component including a data structure for determining a first deflection value based upon the sensed first position, the deflection value being a distance between an actual first position of the linkage and the sensed first position as a result of flex of the linkage due to a load on the linkage, the memory component also being configured to determine the compensated first position of the linkage based on the sensed first position and the first deflection value; and a processor for executing the data structure to determine the compensated first position of the linkage.

14. The system of claim 13, wherein the at least one sensor is configured to sense a second position of the linkage, and wherein the data structure is configured to determine a compensated second position of the linkage based on the sensed second position and a second deflection value, the second deflection value being based upon the sensed second position, the data structure also being configured to combine the compensated first and second positions to determine a compensated offset distance between the compensated first and second positions.

15. A system for determining a compensated offset distance between a first and a second position of a linkage of a machine, comprising:

at least one sensor operably associated with the machine and configured to sense a first position and a second position of the linkage;

a memory component including a data structure for determining the compensated offset distance of the linkage based on the sensed first and second positions and a deflection value, the deflection value being based upon the sensed first and second positions, the data structure being configured to determine a measured offset distance based upon the sensed first and second positions, and configured to compensate the measured offset distance by the deflection value to calculate the compensated offset distance; and a processor for executing the data structure to determine the compensated offset distance of the linkage.

16. The system of claim 15, further including a display configured to show the compensated offset distance, the compensated offset distance being displayed as a horizontal and a vertical distance.

17. The system of claim 15, the data structure including first, second, and third data boxes, the first data box being an algorithm for calculating a measured offset distance based upon the sensed first and second positions, the second data box being an algorithm for calculating the deflection value at the first and second sensed positions, and the third data box being an algorithm for combining the measured offset distance and the deflection value to determine the compensated offset distance.

18. The system of claim 15, further including at least one sensor operably associated with the machine to sense loads applied to the linkage, the deflection value being based upon the sensed applied loads and the sensed first and second positions.

19. The system of claim 15, further including:

a hydraulic actuator coupled with the linkage, the extension of the hydraulic actuator being sensed by the at least one sensor; and a pressure sensor operably associated with the hydraulic actuator for measuring the pressure of hydraulic fluid within the hydraulic actuator to determine applied loads, the deflection value being based upon the sensed first and second positions and the applied loads, and wherein the compensated offset distance is continuously determined.

20. A method for determining a compensated depth of an excavation using a work implement tip of a digging linkage of a work machine, comprising:

placing the work implement tip at a first reference point, the first reference point being a first position;

sensing the first position of the work implement tip;

placing the work implement tip at the bottom of the excavation, the bottom of the excavation being a second position;

sensing the second position of the work implement tip;

determining deflection values associated with the sensed first and second positions; and determining a compensated depth of the excavation based on the sensed first and second positions and the determined deflection values.

21. A method for determining a compensated first position of a linkage of a machine, comprising:

sensing a first position of the linkage;

determining a first deflection value as a distance between an actual first position of the linkage and the sensed first position as a result of flex of the linkage due to a load applied against the linkage; and utilizing the sensed first position and the determined first deflection value to calculate a compensated first position of the linkage.

22. The method of claim 21, wherein the load applied to the linkage is gravity.

23. The method of claim 21, wherein the load applied to the linkage is a resistive force from the ground.

24. A method for determining a compensated offset distance between a first and a second position of a linkage of a machine, comprising:

sensing a first position and a second position of the linkage;

determining a measured offset distance of the linkage between the sensed first and second positions;

determining a deflection value based upon a load applied to the linkage; and determining a compensated offset distance of the linkage based on the sensed first and second positions and the deflection value by compensating the measured offset distance with the deflection value to obtain the compensated offset distance.

25. The method of claim 24, wherein determining a deflection value includes obtaining the deflection value from finite element analysis.

26. The method of claim 24, wherein determining a deflection value includes obtaining the deflection value of the linkage from a table based on the sensed first and second positions.

* * * * *